United States Patent [19]

Mitman et al.

[11] 4,210,041

[45] Jul. 1, 1980

[54] METHOD FOR CUTTING A PLURALITY OF IDENTICAL, IRREGULAR, NON-POLYGONAL PIECES FROM MATERIAL WITH MINIMUM WASTE

[75] Inventors: Enrique Mitman, Brookline; Isaac Sadovnik, Cambridge, both of Mass.

[73] Assignee: Enrique Mitman, Brookline, Mass.

[21] Appl. No.: 10,366

[22] Filed: Feb. 8, 1979

[51] Int. Cl.[2] ..... B26F 1/38

[52] U.S. Cl. ..... 83/32; 33/11; 33/17 R; 76/107 R; 83/50; 83/55

[58] Field of Search ..... 83/32, 50, 55, 48, 56; 33/11, 17 R; 76/107 R, 107 C

[56] References Cited

U.S. PATENT DOCUMENTS

| | | | |
|---|---|---|---|
| 1,830,819 | 11/1931 | Wishmeier | 83/32 X |
| 1,942,043 | 1/1934 | Anderson | 83/32 |

FOREIGN PATENT DOCUMENTS

| | | | |
|---|---|---|---|
| 332752 | 7/1930 | United Kingdom | 83/32 |

*Primary Examiner*—Frank T. Yost

*Attorney, Agent, or Firm*—Pearson & Pearson

[57] ABSTRACT

A plurality of identical, irregular, non-polygonal pieces, such as motorcycle silhouette games pieces, are cut from flat stock of predetermined width and indefinite length with minimum waste of the stock, by laying out a gang cutter "pattern", "marker" or "stencil" in a sequence of steps comprising (1) "boxing in" the curved outline of one non-polygonal piece to form a plane polygonal figure of three sides or more, (2) combining two such polygonal figures into a parallelogram, (3) nesting any protuberance in one piece into any recess in the other piece to reduce the area of the parallelogram (4) laying out a plurality of said parallelograms side by side across the width of the stock and (5) successively cutting the resulting pattern from the stock by a gang cutter arranged in the pattern.

6 Claims, 23 Drawing Figures

METHOD FOR CUTTING A PLURALITY OF IDENTICAL, IRREGULAR, NON-POLYGONAL PIECES FROM MATERIAL WITH MINIMUM WASTE

BACKGROUND OF THE INVENTION

It has long been a problem to cut flat, planar pieces of a predetermined outline from flat sheet or web stock, with minimum waste of the material of the stock.

In U.S. Pat. No. 3,596,068 to Doyle of July 27, 1971, a system for cutting patterns of different outline from stock with a minimum waste is disclosed. The system requires the use of a computer and calls for the steps of digitizing the various individual pieces by converting the boundaries into arrays of digital coordinate positional information and supplying the resultant information directly to a computational unit. Thereafter a succession of augmenting, computing, scanning, operating, multiplying and testing steps are involved to produce the desired result. The pieces exemplified in the Doyle method are non-circular and polygonal and the salient boundary points to be digitized are vertices of the angular corners of a polygon.

In U.S. Pat. No. 4,043,234 to Godin et al of Aug. 23, 1977, a system is disclosed for arranging a plurality of circles of identical diameter on sheet stock with minimum waste of the stock. In the Godin patent the sheets are of parallelogram outline rather than of rectangular outline and the transverse forward and rearward edges of the sheet are at an angle of sixty degrees to the longitudinal edges of the sheet.

SUMMARY OF THE INVENTION

In this invention, unlike the polygonal, non-identical pieces of the above-mentioned Doyle patent and unlike the circular, identical pieces of the above-mentioned Godin patent, the pieces to be cut are non-polygonal and are non-circular but they are identical with each other while having curved side edges rather than straight side edges.

In the method of the invention, and in order to lay out the optimum repeat pattern on a gang cutter, to produce the minimum waste of stock, the non-polygonal, non-circular planar piece, or object, of rounded outline is first marked with its salient points. It is then boxed in with straight lines to outline a polygonal figure of at least three sides such as a triangle, trapezoid or parallelogram. A pair of the boxed in polygonal figures are then combined into a parallelogram, and any protuberance in one figure of the pair is nested in a recess in the other figure of the pair to reduce the total area of the parallelogram. The parallelograms are then arranged side by side for a width equal to the width of the web or sheet, preferably having first been nested laterally to reduce lateral width.

The gang cutter is then arranged in the resulting repeat pattern so that it can be repeatedly cut out of the sheet stock in a stack or out of an elongated web of stock advancing thereunder.

BRIEF DESCRIPTION OF THE DRAWING

FIG. 1 is a plan view of a typical flat, planar object, or piece which it is desired to cut in multiples by a gang cutter from flat sheet or web stock of fixed width and indefinite length;

FIG. 2 is a view similar to FIG. 1 but showing the salient points marked around the curved outline of the object;

FIG. 3 is a view similar to FIGS. 1 and 2 showing two polygonal, boxed in pieces combined into a parallelogram;

FIGS. 1A–4A, FIGS. 1B–4B, FIGS. 1C–4C and FIGS. 1D–4D are views similar to FIGS. 114 4 showing the application of the method steps to flate pieces of different, generally curved outlines.

DESCRIPTION OF A PREFERRED EMBODIMENT

Figures 1, 1A, 1B, 1C, 1D, 2, 2A, 2B, 2C, 2D, 3, 3A, 3B, 3C, 3D:
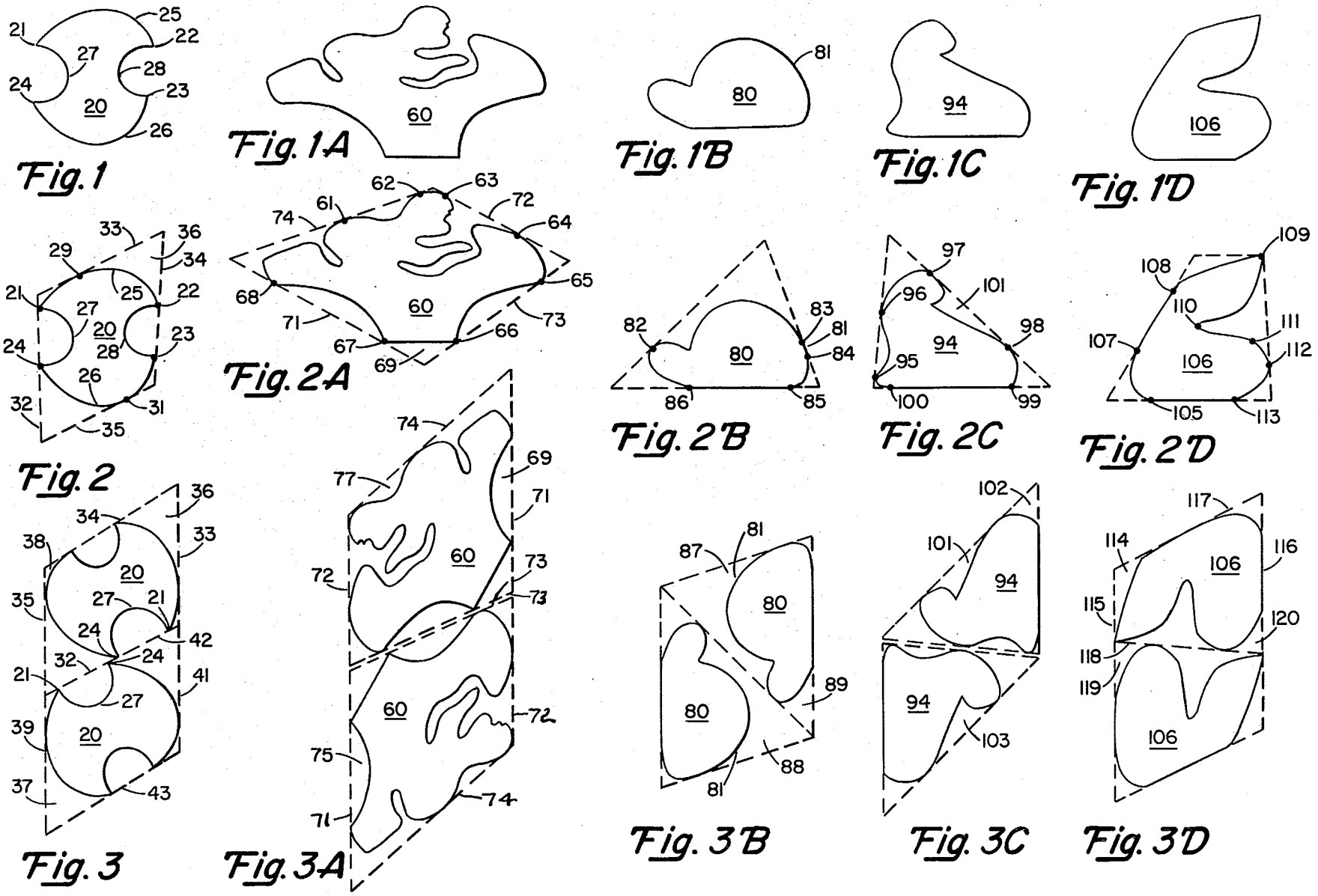

In FIG. 1 a typical flat, planar object, or piece 20 is shown in plan, such as might be a part of a pattern of fabric for a garment, or for a seat cover in an automobile, or a special part to be cut from sheet metal, paper, or plastic or relatively thick or thin sheet or web stock of any kind.

The piece 20 has one or more salient points 21, 22, 23 or 24, it is not circular, polygonal or symmetrical so that it is characterized herein as an irregular, asymmetrical rounded-outline object.

If piece 20 was circular, and identical circles were desired, they could be cut as in the Godin patent above. If piece 20 was a polygon with straight sides it would come within the scope of the Doyle patent above.

However, prior to the disclosure herein, to my knowledge, there has been no method, known or used commercially, to readily lay out multiple identical, irregular patterns on stock, with minimum wastage, except by luck, trial and error and prolonged experimentation.

The piece 20 has the convex curved side edges 25 and 26 and the concave side edges 27 and 28. The corner, or point 21 differs from the other corners or points 22, 23 and 24 to make the piece irregular and asymmetrical.

The first step in the method of the invention is to mark the salient points around the rounded irregular, assymmetrical obect 20 as at 21, 22, 23 and 24 as well as at 29 and 31. The salient points are then connected by straight lines such as the dotted lines at 32, 33, 34 and 35 to form a plane, polygonal figure 36 with three or more sides, such as a triangle, trapezoid or parallelogram. The polygonal figure 36 is a trapezoid with sides 33 and 35 in parallelism and sides 32 and 34 not parallel.

The next step in the method is shown in FIG. 3 and consists in combining the polygonal figure 36 with an identical figure 37, in such a way that the two trapezoidal, polygonal, figures jointly outline a plane, closed parallelogram figure 38, each figure 36 and 37 containing the outline of a piece, or object 20. This is accomplished by arranging the parallel sides 33 and 35 of figure 36 in extension of the parallel sides 39 and 41 of figure 37 with one of the non-parallel sides 32 of figure 36 juxtaposed with and registering with the corresponding non-parallel side 42 of figure 37. The non-parallel side 43 of figure 37 then becomes parallel to the non-parallel side 34 of figure 36 to complete the plane, closed, parallelogram figure 38.

In combining the trapezoid figures 36 and 37 into the parallelogram figure 38, one of the salient points 24 of object 20, which is a projection from one side of the object, is located opposite a corresponding recess 27 on one side of the other object 20 of the pair.

Figure 4D:
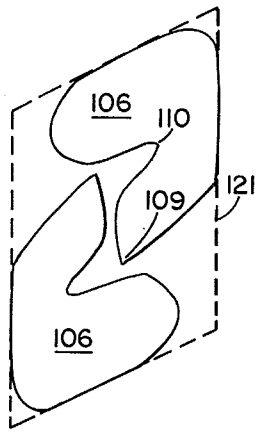
Figure 4C:
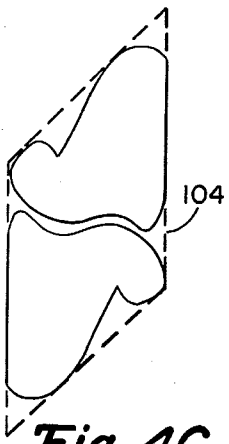
Figure 4B:
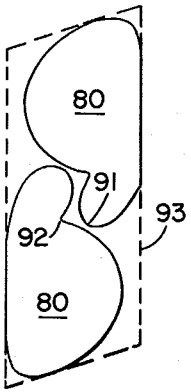
Figure 4A:
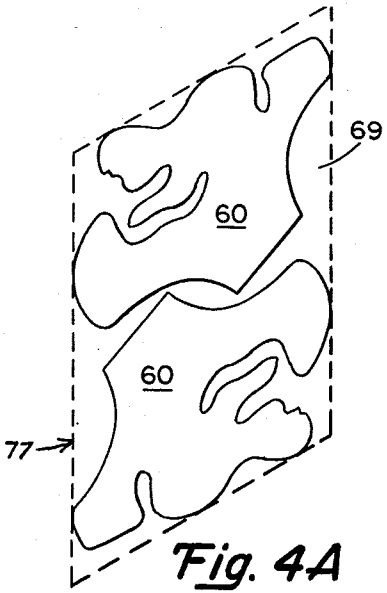
Figure 4:
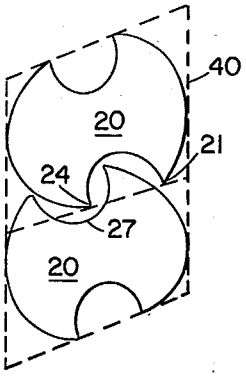
FIG. 4 is a view similar to FIGS. 1–3, showing the pieces within the parallelogram nested to a reduced area.

The next step of the method, as shown in FIG. 4, is the nesting of a projection 24 of one object 20 into a recess 27 of the other object 20 of the pair to reduce the overall area of the plane, parallelogram figure 38, to a parallelogram figure 40 and to establishe minimum spacing between the pair of objects. It will be understood that a predetermined spacing between objects is usually maintained so that they preferably do not touch each other, for example one eighth or one quarter of an inch depending on the characteristics of the stock and the thickness of the cutting dies.

Figure 5:
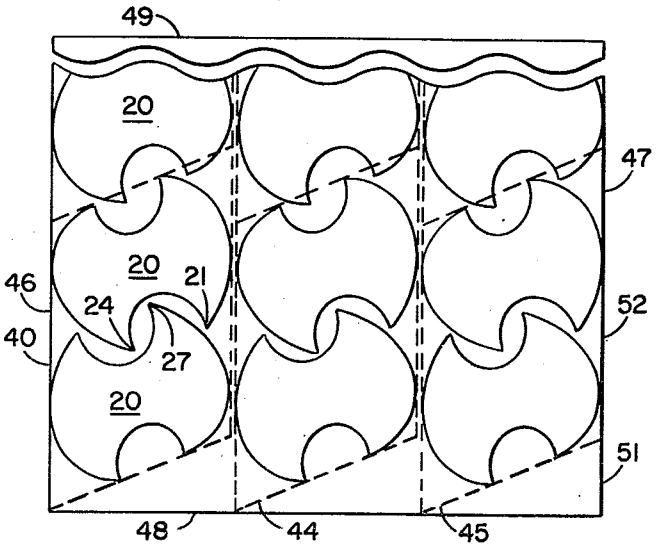
FIG. 5 is a view similar to FIGS. 1–4 showing a plurality of parallelograms, containing the desired shape of piece, arranged side-by-side in a multiple pattern of identical, nested, pieces, across the width of the sheet or web stock with minimum spacing and minimum waste of stock.

The next step in the method is to arrange a plurality of the nested, closed, parallelogram figures 40, in side by side, juxtaposed, position across the predetermined width of the shheet or web stock 51 as shown at 40, 44 and 45 in FIG. 5. The sheet or web 51 has parallel longitudinal side edges 46 and 47, a starting lateral edge 48 and an ending lateral edge 49 as shown.

Figure 6:
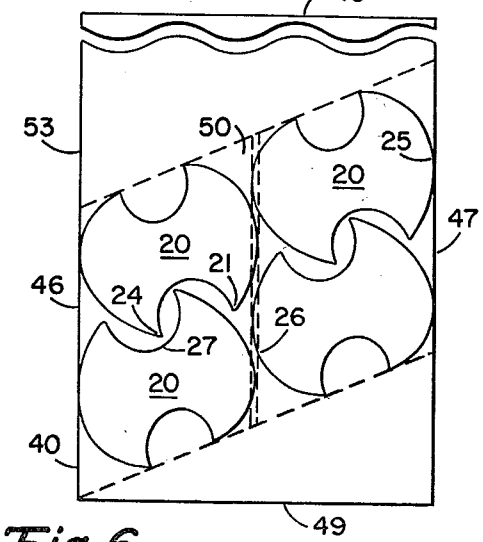
FIG. 6 is a view similar to FIG. 5 showing the pieces of FIG. 5 arranged in regular scroll form with the pieces laterally nested as well as longitudinally nested.

An additional step is preferably performed as shown in FIG. 6, wherein the objects 20 in each plane, parallelogram, figure 40, are nested sidewise, or laterally, with a projecting portion such as the curved edge 25 or 26 of one piece 20 received in a recess in the adjacent parallelogram 40, such as the space 50 between the pair of objects 20 to nest the objects laterally as well as longitudinally to reduce the area occupied by the objects still further.

Figure 7:
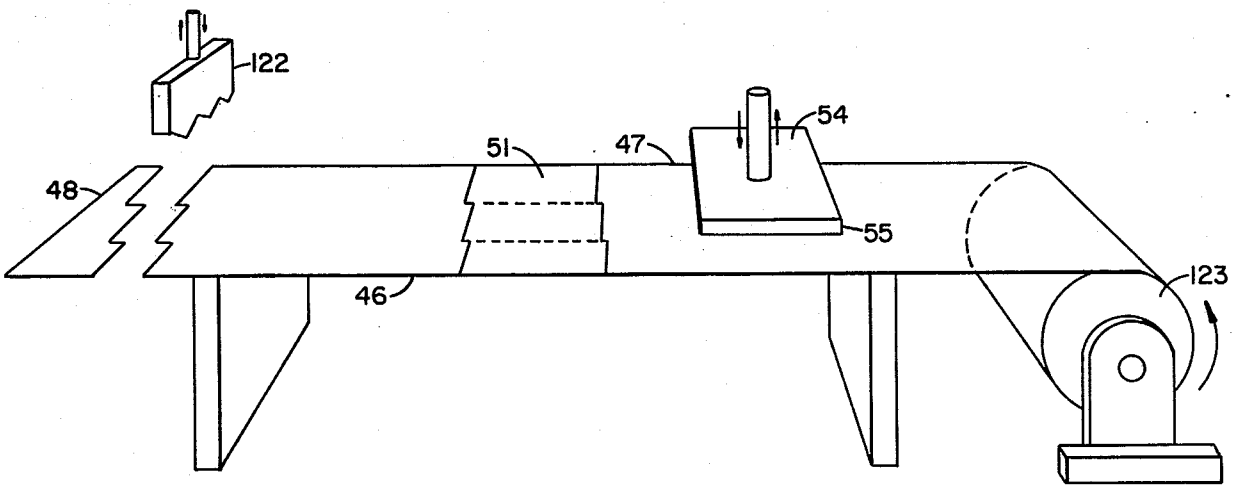
FIG. 7 is a diagrammatic perspective view of a gang cutter arranged to repeatedly cut the multiple pattern of identical pieces shown in FIG. 6 from a web advanced intermittently thereunder.

The multiple repeat pattern 52 developed by the method of the invention and shown in FIG. 5, or the even further nested multiple repeat pattern 53 shown in FIG. 6 is then translated into the form of a gang cutter 54, the cutting edges 55 thereof being arranged to repeatedly cut the pattern 52, or 53, from the sheet or web stock 51 in the manner shown in FIG. 7.

Thus a maximum number of the identical objects 20 are repeatedly cut from the stock 51 with minimum spacing therebetween and minimum wastage of the material.

The cutting sheet, or web 51, will not usually be a perfect rectangle, but will be a scroll cut as shown in FIG. 6, the scrolls may be arranged horizontally and all of the same height (FIG. 5) or they may be on the diagonal as in FIG. 6, or they may be a combination thereof with the parallelograms defining an angle between the horizontal and the parallelogramic angle as shown in FIG. 7.

To further exemplify the process of the invention, an irregular game piece figure 60 is shown in FIGS. 1A, 2A, 3A and 4A, which are similar to the corresponding FIGS. 1–4. Object 60 represents a motorcycle and rider and is most irregular in outline. The salient points 61, 62, 63, 64, 65, 66, 67 and 68 are marked and connected by straight dotted lines to outline a trapezoid 69 with parallel sides 71 and 72 and non-parallel sides 73 and 74.

As explained above trapezoid 69 and an identical trapezoid 75, have their non-parallel sides 73 and 73 registered and juxtaposed to thereby form a parallelogramic figure 77. The objects 60 within the figure 77 are then nested longitudinally within figure 77. The adjacent figures 77 in the repeat pattern have their objects nested laterally to produce the desired multiple repeat pattern desired for the gang cutters.

In FIGS. 1B, 2B, 3B and 4B the steps of the method are applied to an irregular piece 80 with rounded sides 81, the piece resembling a snail, seal or turtle. The steps of the method consist in marking the salient points 82, 83, 84, 85 and 86, then boxing in the piece 80 with straight lines which in this case form a three sided figure, namely a triangle 87. Triangle 87 is then combined with an identical triangle 88 to form a plane, closed parallelogram figure 89. The next step is to nest the projection 91 of one piece with the recess 92 of the other piece as shown in FIG. 4B to reduce the area of the figure 89 to form a parallelogram 93. Thereafter the multiple repeat pattern of side by side parallelograms 93 is formed in the cutting edges 55 of the gang cutter 54 to cut the pieces 80 in the optimum manner with minimum wastage of material.

The piece 94 shown in FIGS. 1C, 2C, and 3C are marked with salient points such as 95, 96, 97, 98, 99 and 100 boxed in with straight lines into the triangle 101, (FIG. 2C) combined into a parallelogram figure 102, with an identical triangle 103, nested into a parallelogram 104 of reduced area and then formed into a multiple repeat pattern of side by side parallelograms 104, in the manner described above.

In FIGS. 1D–4D a rounded piece, or object, 106 similar to the polygonal figure exemplified in the above mentioned Doyle patent, is illustrated. Piece 106 is marked with salient points 105, 107, 108, 109, 110, 111, 112, and 113, the point 109 being a protuberance and the point 110 marking a recess. The salient points are used to box in the piece 106 to outline a trapezoid 114 with parallel sides 115 and 116 and non-parallel sides 117 and 118. The trapezoid 114 is combined with an identical trapezoid 119 to form the parallelogram 120, and the protuberance 109 of one piece is nested in the recess 110 of the other piece 106 to form the parallelogram 121 of reduced area.

The remaining steps are as described in the description of steps applied in FIGS. 1–8, to obtain the desired repeat pattern of gang cutting dies.

If the material 51 comes from rolls, as is usually the case, there is a need for a specially designed sheeting cutter 122 with the "scroll cut"; otherwise cutting of the parallelograms can be done directly from the unwinding roll 123 of material 51 by positioning the cutting dies 54 in a parallelogramic or scroll pattern of FIG. 6.

If the scroll cutter 122 needed to cut the sheets from the roll 123 is uneconomical or unfeasible for a given material, the parallelogramic shape of FIG. 6 should be preferred even though further nesting would be accomplished with the scroll cut. Cutting in parallelogramic shape wastes a little more than the scroll shape at the beginning 48 and end 49 of the web but this waste is insignificant in view of the length of the web.

The term gang cutter is used herein to mean a single die cutter or a multiple die cutter in the repeat pattern.

It will be noted that in a complex figure such as shown in FIGS. 1A, 2A, 3A and 4A, there are a number of salient points which can be selected for the outlining, or "boxing in", of the figure, leaving certain salient points untouched by the "box in" lines. Once the obvious salient points 65, 66 and 67, 68 have been joined by a straight line, it is only necessary to join two salient points on a third side and then to make the fourth side parallel to one of the first two selected sides to thereby create a trapezoid, even if the fourth side only includes one salient point.

We claim:

1. The method of simultaneously cutting a plurality of identical, two-dimensional, objects of irregular, asymmetrical, rounded outline from elongated sheet, or web stock having opposite parallel side edges; said stock advancing in individual, successive increments through a station having a reciprocating gang cutter, which method comprises the steps of:

marking the salient points around one of said rounded objects and connecting adjacent said points by straight lines to box said irregular, asymmetrical object into a plane polygonal figure with three or more sides, such as a triangle, trapezoid or parallelogram;

combining a pair of said polygonal figures into a plane closed parallelogram figure with a projection on one side of one object of the pair located opposite a recess on one side of the other object of the pair;

nesting the said projection of one object in the recess of the other object of the pair to reduce the area of the said plane closed parallelogram figure and to establish minimum spacing between said objects;

arranging a plurality of said closed parallelogram figures, with one pair of the parallel sides of each figure juxtaposed side by side with corresponding parallel sides of adjacent said figures, to define a multiple repeat pattern equal in width to the width of said stock;

and arranging the dies of said gang cutter into said multiple, repeat pattern to repeatedly cut the same from said stock with minimum waste thereof.

2. The method specified in claim 1 plus the step of :

nesting the side wise projections within said juxtaposed, plane, closed parallelogram figures within corresponding side wise recesses thereof to reduce the area of said figures and to create minimum lateral spacing therebetween and arranging the dies of said gang cutter to correspond to said lateral nesting of said plane, closed parallelogram figures.

3. A method of simultaneously cutting a plurality of identical irregular shaped objects of rounded outline from advancing sheet or web, stock having opposite parallel side edges to reduce stock waste comprising the steps of:

creating a multiple repeat gang cutter pattern by marking a plurality of salient points around each of the sides of at least one of said objects of rounded outline and drawing a straight line joining each adjacent pair of said points to box said object into a closed geometrical, straight-sided, polygonal figure including a triangle, parallelogram or trapezoid;

combining a pair of said closed polygonal figures into a parallelogram with a side of one figure, having at least one said salient point forming a projection, positioned opposite a side of the other figure of the pair having at least two salient points forming a recess therebetween, reducing the area of said parallelogram by nesting the projection on one said figure in the recess in the other said figure so that there is only a predetermined minimum space therebetween, then arranging a plurality of said parallelograms each containing a pair of said nested figures, in side by side relationship with one pair of parallel sides thereof parallel to said parallel side edges of said sheet or web stock to form a die cutting pattern and then simultaneously die cutting said pattern out of said stock repeatedly in succession as said stock advances.

4. A method as specified in claim 3 plus:

the step of nesting a projection in each parallelogram, having its sides parallel to the edges of said sheet or web stock laterally with a recess in the adjacent parallelogram to reduce the lateral width of said die cutting pattern.

5. A method as specified in claim 3 wherein:

said plurality of parallelograms are arranged laterally across said sheet or web in scroll fashion.

6. A method as specified in claim 3 wherein:

said plurality of parallelograms are arranged laterally across said sheet or web in staggered scroll fashion.

* * * * *